US006553574B1

(12) United States Patent
Hall, Jr. et al.

(10) Patent No.: US 6,553,574 B1
(45) Date of Patent: Apr. 29, 2003

(54) WEIGHTED THERAPEUTIC GLOVE

(76) Inventors: Bruce L. Hall, Jr., 4517 Aviemore Crescent, Raleigh, NC (US) 27604; Nathan Wayne Evans, 7033 Langwood Dr., Raleigh, NC (US) 27612

( * ) Notice: Subject to any disclaimer, the term of this patent is extended or adjusted under 35 U.S.C. 154(b) by 0 days.

(21) Appl. No.: 09/441,842

(22) Filed: Nov. 17, 1999

Related U.S. Application Data

(60) Provisional application No. 60/108,760, filed on Nov. 17, 1998.

(51) Int. Cl.[7] ..... A41D 19/00

(52) U.S. Cl. ..... 2/160; 2/161.1; 2/250; 601/40

(58) Field of Search ..... 2/20, 158, 159, 2/160, 161.1, 161.2, 161.4, 162, 163, 169, 247, 250; 601/40; 128/878, 879; 602/21; 473/205, 415, 450

(56) References Cited

U.S. PATENT DOCUMENTS

| | | | | | |
|---|---|---|---|---|---|
| 3,124,806 | A | * | 3/1964 | Campbell et al. | 2/159 |
| 3,944,220 | A | * | 3/1976 | Fasano | 272/67 |
| 4,034,979 | A | | 7/1977 | Wester | 273/54 B |
| 4,330,120 | A | * | 5/1982 | Netti | 272/119 |
| 4,368,883 | A | * | 1/1983 | Tiktin | 272/67 |
| 4,556,215 | A | | 12/1985 | Tarbox et al. | 272/119 |
| 4,575,075 | A | | 3/1986 | Tarbox et al. | 272/119 |
| 4,684,123 | A | | 8/1987 | Fabry | 272/119 |
| 4,813,079 | A | * | 3/1989 | Reitzel | 2/160 |
| 4,911,433 | A | * | 3/1990 | Walker et al. | 272/119 |
| 4,923,418 | A | | 5/1990 | Hoffman | 441/57 |
| 5,182,814 | A | * | 2/1993 | Christensen | 2/161 |
| 5,300,000 | A | | 4/1994 | Schwartz | 482/105 |
| 5,353,440 | A | * | 10/1994 | Meldeau | 2/161.1 |
| 5,675,839 | A | * | 10/1997 | Gordon et al. | 2/159 |
| 5,768,710 | A | | 6/1998 | Williams | 2/161.1 |

* cited by examiner

*Primary Examiner*—John J. Calvert
*Assistant Examiner*—Katherine Moran
(74) *Attorney, Agent, or Firm*—Coats & Bennett, P.L.L.C.

(57) ABSTRACT

A weighted therapeutic glove has a back-hand side, a palm side, a thumb opening, and at least one finger opening. Positioned on the back-hand side are back-hand pockets for removably receiving first weights. The back-hand pockets are oriented to open on the back-hand side proximate the thumb opening so that the first weights are insertable from a direction of the at least one thumb opening substantially laterally to the ulnar edge of a wearer's hand. On the palm side, a palm pocket is provided for removably and containably receiving one or more second weights. The palm pocket has at least one sleeve affixed to the palm side for receiving the second weight.

11 Claims, 3 Drawing Sheets

WEIGHTED THERAPEUTIC GLOVE

This application claims benefit of U.S. Provisional Patent Application No. 60/108,760 filed Nov. 17, 1998, which is incorporated herein by reference.

FIELD OF THE INVENTION

This invention relates to a variable weight therapeutic glove, which can be used to increase strength of or reduce tremors in a wearer's arm.

BACKGROUND OF THE INVENTION

Patients suffering from upper extremity injury or debilitating neurological or muscle diseases are often presented with many rehabilitation and exercise regimens to increase the strength of the effected muscles. Athletes as well utilized exercise regimens to increase muscle strength. One effective regimen utilizes weight devices to increase the individual's upper body, arm and hand strength. Another effective regimen utilizes weight devices to counteract or slow tremors and related involuntary muscle activities. Such weight devices include, for example, weight machines, barbells, dumbbells, weighted utensils, and certain types of weighted gloves. Unfortunately, although weighted gloves have been used in the past, such gloves have been difficult for patients to employ due to their physical configuration. Further, even though the glove weight of such gloves can be varied by inserting or removing weighted inserts, the weighted inserts are difficult to remove and may even require removal of the glove from the individual's hand all together. For the patients describe above, this can be an onerous task.

For example, individuals suffering from reflex sympathetic dystrophy exhibit muscle weakness, muscle atrophy, tremors, and pain from mechanical stimulation or movement. Some therapists tend to follow the distrophile program, which includes carrying weights. However, if the individual desires to utilize his or her hands, they must release the weights, conduct the desired activity, and lift the weights again, resulting in a painful experience. Thus, there is a need for a variable weighted glove in which the wearer can conduct physical activities with his or her hands without removing the glove.

One example of a weighted glove is described in U.S. Pat. No. 5,768,710 to Williams and is directed to a weighted finger exercise/rehabilitation glove. This glove has strip weights permanently imbedded and extending longitudinally in a back-hand portion of the glove. On a palm side, a bar weight is temporarily attached thereto utilizing hook and loop material. The bar weight is covered with either the hook or the loop material and attached to the palm side by engaging it with an attachment strip disposed thereon made of the mating material. However, as indicated above, the strip weights can not be removed to vary the weight of the back-hand side since they are permanently installed, and the bar weight can easily be dislodged from the wearer's palm through minor bumping. As the hook and loop material wears, the attaching strength likewise decreases, which can ultimately render the hook and loop material ineffective.

Similarly, U.S. Pat. No. 4,923,418 to Hoffman is directed to an exercise glove which is variably weighted. However, the weights on the back-hand side are disposed horizontally and substantially parallel with the wearer's fingers. This requires the weights to be withdrawn toward the wearer's wrist, which increases the difficulty of removal for individuals having strength problems. Such a design can require the removal of the glove in order to remove or replace the weights.

Despite existing weighted gloves, the need for a variable weighted glove having easy access to the various weights positioned on a back-hand portion of the glove remains. Further, there remains a need for variable weighted glove having a weighted bar secured to the palm portion that resists accidental dislodgment, yet is easy to remove and interchange with a bar of a different weight. It is to the provision of a weighted glove that meets these needs that the present invention is primarily directed.

SUMMARY OF THE INVENTION

Briefly described, the present invention comprises a weighted therapeutic glove having a back-hand side, a palm side, a thumb opening, and at least one finger opening. Back-hand pockets are provided for removably receiving various weights. The back-hand pockets open on the back-hand side proximate the thumb opening and are oriented so that the at least one first weight is inserted from a direction of the at least one thumb opening substantially laterally to the ulnar edge of a wearer's hand. A palm pocket is positioned on the palm side for removably receiving and containing at least one second weight.

Another aspect of the present invention relates to a weighted therapeutic glove having at least one back-hand pocket for removably receiving at least one first weight, and a palm pocket for removably and containably receiving at least one second weight. The palm pocket comprises at least one sleeve affixed to the palm side and formed from an elastic material. By inserting the at least one second weight into the at least one sleeve, the sleeve stretches and releasably secures the at least one second weight therein.

A significant advantage of the present invention over existing weighted gloves is that the back-hand weights can be removed and inserted without removing or loosening the glove. This is particularly beneficial for individuals having difficulties with hand strength or manual dexterity. Further, a weight can easily be placed into the palm pocket and interchanged with weights of various size and mass.

Thus, a unique weighted therapeutic glove is now provided that successfully addresses the shortcomings of existing gloves and provides distinct advantages over such gloves. Additional objects, features, and advantages of the invention will become more apparent upon review of the detailed description set forth below when taken in conjunction with the accompanying drawing figures, which are briefly described as follows.

DETAILED DESCRIPTION OF THE INVENTION

Figure 1:
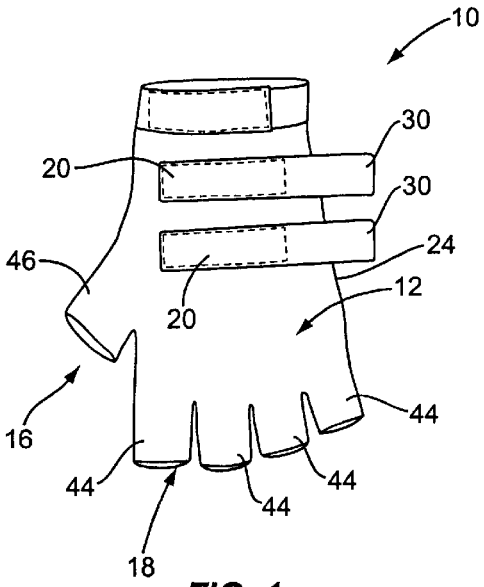
FIG. 1 is a top view of an embodiment of a weighted therapeutic glove made in accordance with the present invention.
Figure 2:
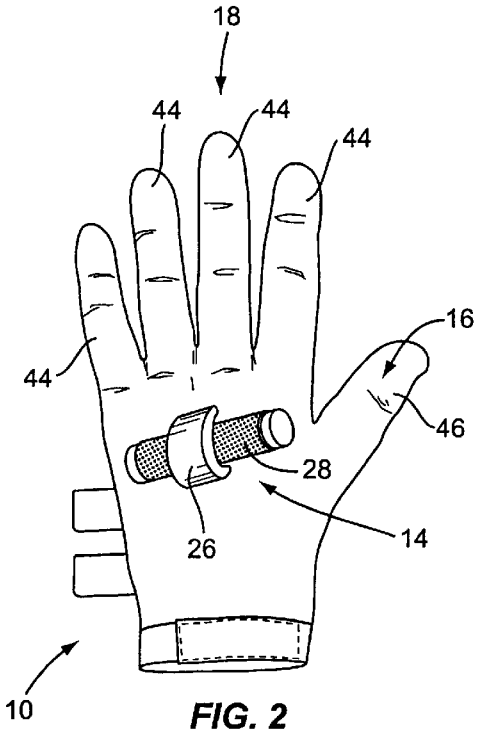
FIG. 2 is a bottom view of another embodiment of the glove of the present invention.

For a more complete understanding of the present invention, reference should be made to the following detailed description taken in connection with the accompanying drawings, wherein like reference numerals designate corresponding parts throughout the several figures. Referring first to FIGS. 1 and 2, a weighted therapeutic glove 10 has a back-hand side 12, a palm side 14, a thumb opening 16, and at least one finger opening 18. Positioned on the backhand side 12 are back-hand pockets 20 for removably receiving first weights 22. The back-hand pockets 20 are oriented to open on the back-hand side 12 proximate the thumb opening 16 so that the first weights 22 are insertable from a direction of the at least one thumb opening 16 substantially laterally to the ulnar edge 24 of a wearer's hand 2. On the palm side 14, a palm pocket 26 is provided for removably and containably receiving one or more second weights 28.

Figure 3:
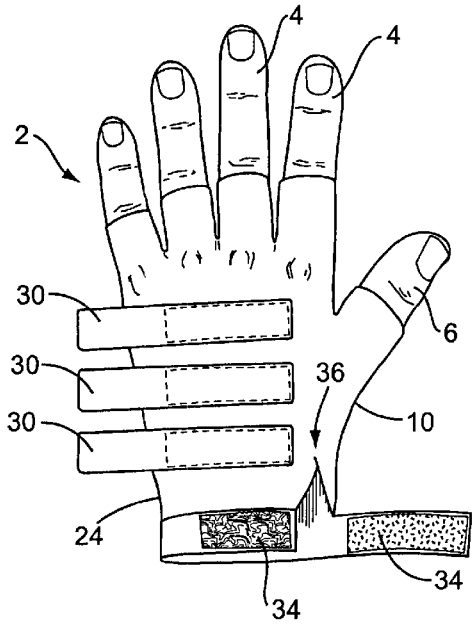
FIG. 3 is a top view of the glove of disposed on a wearer's hand.
Figure 4:
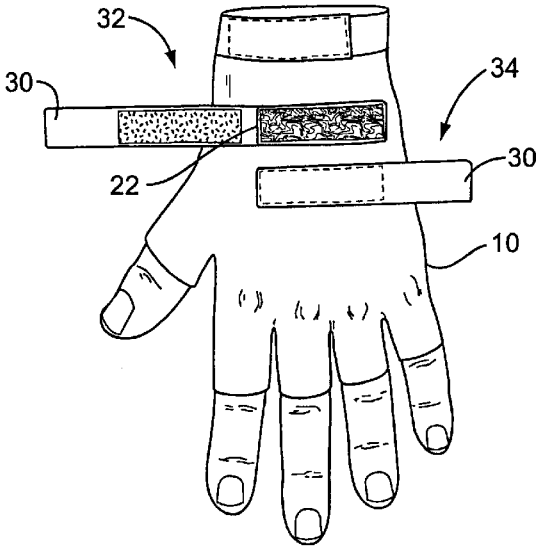
FIG. 4 is a top view of the glove illustrating back-hand pockets and flaps in open and closed positions.
Figure 5A:
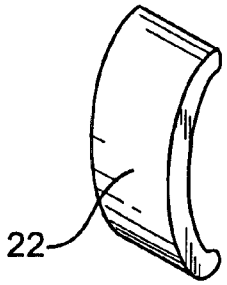
FIGS. 5A and B are perspective views of first weights.
Figure 5B:
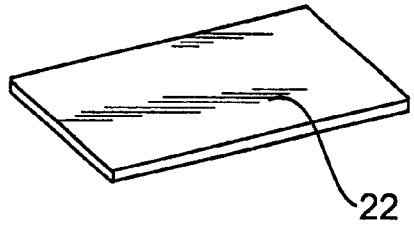

Referring additionally to FIGS. 3, 4, and 5A and B, one or more flaps 30 are positioned on the back-hand side 12 proximate the back-hand pockets 20. Each flap 30 is movable from an open position 32 to a closed position 34 for removably enclosing the first weights 22 respectively within the back-hand pockets 20. Hook and loop material is respectively provided on the flap 30 and the back-hand side 12 to removably retain the flap 30 in the closed position 34. Preferably, the first weights 22 are rectangularly shaped bars. The first weight 22 can be made from any desired material, with lead or an alloy thereof being preferred. As indicated in FIG. 5A, the first weights 22 can be curved to simulate the lateral curvature of the back of an individual's hand (not shown), or as indicated in FIG. 5B, the first weight 22 can be flat. The first weights 22 are also preferably coated to provide a protective barrier for preventing lead exposure to the wearer. For example, such coatings can include carbon and silicone based polymeric coatings and ceramic coatings.

Figure 6:
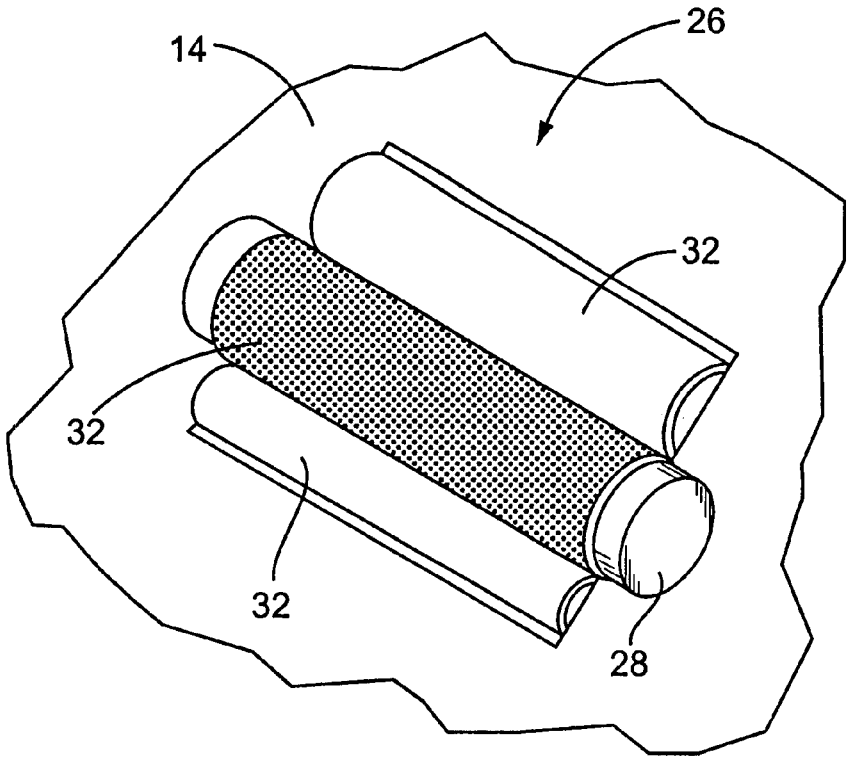
FIG. 6 is a partial perspective view of the glove illustrating a palm pocket.

As illustrated on FIGS. 2 and 6, the palm pocket 26 can be a pocket in the traditional sense, such as, the back-hand pocket 20. Preferably, the palm pocket 26 comprises at least one sleeve 32 affixed to the palm side 14 for receiving the second weight 28. The sleeves 32 of the palm pocket 26 are open-ended and formed from a heavy-duty elastic material. As indicated in FIG. 6, the sleeves 32 are substantially cylindrically-shaped with the diameter thereof less than the cross-sectional diameter of the second weight 28. As the second weight 28 is inserted into the respective sleeve 32, the sleeve 32 stretches to form a releasable grip on the second weight 28. Although the grip on the second weight 28 should be tight enough to secure the at least one second weight 28 within the sleeve 32, it should not prevent withdrawal therefrom by the wearer. As indicated in FIG. 6, the second weights 28 are cylindrically shaped bars manufactured from the same materials at the first weights 22 and are likewise coated.

Figure 7A:
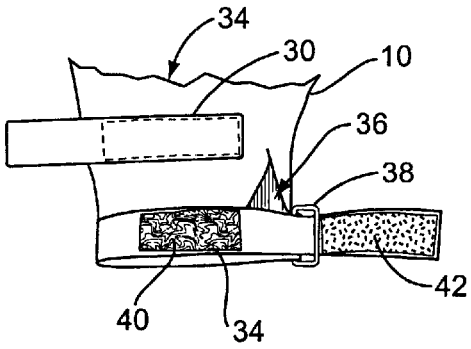
FIGS. 7A and B are partial top views of a right-handed glove made in accordance with the present invention illustrating an adjustment strap.
Figure 7B:
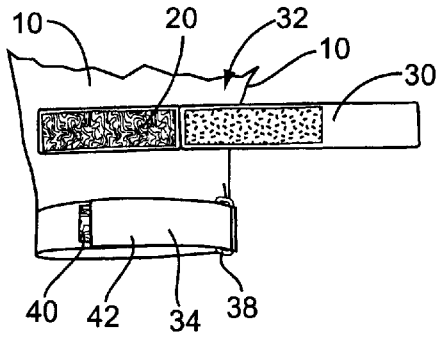

Referring again to FIG. 3 and additionally to FIGS. 7A and 7B, the glove 10 has a releasable adjustment strap 34 positioned to tighten a portion of the glove 10 to secure the glove 10 on a wearer's hand. Preferably, the glove 10 has a slit 36 to expand and assist in placing the glove 10 on the wearer's hand. In the embodiment of FIG. 3, the strap 34 comprises either hook or loop material positioned on one side of the slit 36 and the mating material positioned on the other side of the slit 36. The hook and the loop material are mated together to removably secure the glove 10 to the wearer's hand. In the embodiment shown in FIGS. 7A and B, a D-ring 38 is pivotally mounted to the glove 10 and positioned on one side of the slit 36. The adjustment strap 34 comprises a hook material portion 40 and a loop material portion 42 mounted to the glove 10 on the other side of the slit 36. By inserting the adjustment strap 34 through the D-ring 38 and folding the strap 34 upon itself, the hook material portion 40 releasably and adjustably engages the loop material portion 42 to secure the glove 10 on the wearer's hand. For individuals who have strength or dexterity difficulties, the D-ring 38 and adjustment strap 34 combination is preferred.

As shown in FIGS. 1 and 2, the at least one finger opening 18 comprises finger sleeves 44 for each of a wearer's fingers 4. Likewise, the thumb opening 16 comprises a thumb sleeve 46. The embodiment illustrated in FIG. 1, and in FIGS. 3 and 4, has finger and thumb sleeves 44 and 46 terminating to expose an end of each finger 4 and thumb 6 of the wearer. Alternatively, as shown in FIG. 2, the finger and thumb sleeves 44 and 46 have closed ends.

The glove 10 of the present invention can be manufactured from woven or non-woven materials, polymeric sheeting (e.g., neoprene), leather, or any other durable material suitable for wear. Preferably, the material utilized is pliable and non-moisture retaining. When leather is utilized, the glove 10 preferably has an elastic strip sewn into the seam (not shown) of the glove 10 proximate the ulner edge 24 to enhance moisture release.

Without limiting the scope of the present invention, the first weights 22 are preferably in 2 ounce and 4 ounce sizes, and the second weights 28 are preferably in 6 ounce and 8 ounce sizes. First and second weights 22 and 28 can be provided having any desired or predetermined weight or mass.

The glove 10 of the present invention may be utilized for any therapeutic or athletic strength-training program for improving the strength of the individuals arms and hands. This process entails providing a glove made in accordance with the present invention and inserting the individual's hand into the glove. By placing the hand in motion during routine daily activities or by predetermined repetitive movements designed to target and exercise specific muscles or groups of muscles, the individual's hand and arm strength can be increased. Further, by wearing the glove 10 during routine activities, a patient suffering from hand or arm tremors can find a reduction in the severity of the involuntary hand or arm movement.

The present invention further includes a kit for increasing hand and arm strength. The kit includes at least one weighted therapeutic glove 10 made in accordance with the present invention, at least one first weight 22 for insertion into the back-hand pocket 20 of the glove 10, and at least one second weight 28 for insertion into the palm pocket 26 of the glove 10.

Although the invention has been described in detail for the purpose of illustration, it is understood that such detail is solely for that purpose, and variations can be made therein by those skilled in the art without departing form the spirit and scope of the invention which is defined by the following claims.

What is claimed is:

1. A weighted therapeutic glove, comprising:

a glove having a back-hand side, a palm side, a thumb opening, and at least one finger opening;

at least one back-hand pocket for removably receiving at least one first weight, wherein the at least one back-hand pocket opens on the back-hand side proximate the thumb opening and is oriented so that the at least one first weight is insertable from a direction of the at least one thumb opening substantially laterally to the ulnar edge of a wearer's hand; and a palm pocket for removably and containably receiving at least one second weight.

2. The glove according to claim 1, further comprising a releasable adjustment strap positioned to tighten a portion of the glove to secure the glove on a wearer's hand.

3. The glove according to claim 1, further comprising:

a slit;

a D-ring positioned on one side of the slit; and an adjustment strap comprising a hook material portion and a loop material portion positioned on the other side of the slit, whereby upon insertion of the adjustment strap through the D-ring and folding the strap upon itself, the hook material releasably and adjustably engages the loop material to secure the glove on a wearer's hand.

4. The glove according to claim 1, further comprising at least one flap positioned on the back-hand side proximate the back-hand pocket movable from a open position to a closed position for removably enclosing the at least one first weight within the back-hand pocket.

5. The glove according to claim 1, wherein the palm pocket comprises at least one sleeve affixed to the palm side and formed from an elastic material, whereby upon insertion of the at least one second weight into the at least one sleeve, the sleeve stretches and releasably secures the at least one second weight therein.

6. A method of treating a patient with hand or arm tremors and reducing the severity of such tremors comprising:

a). attaching one or more weights to a glove;

b). fitting the weighted glove on the patient's hand; and c). wherein the weighted glove counteracts the tremors and tends to stabilize the patient's hand and arm and reduces the severity of the tremors.

7. The method of claim 6 wherein the weighted glove for treating arm and hand tremors is adapted to receive a series of varying weights.

8. A glove adapted to hold a series of weights comprising: a thumb opening and a series of finger openings; a back side; a palmside; a series of spaced apart transversely extending weight pockets formed on the back side with each weight pocket including an inlet opening through which a weight may be inserted and wherein the inlet opening is formed on a thumb side of the glove such that weights may be inserted into the respective pockets from the thumb side of the glove; and a closure flap associated with each weight pocket for closing the inlet opening; and at least one weight sleeve formed in the palm of the glove for receiving and holding a weight.

9. The glove of claim 8, wherein each weight pocket is formed by an elongated sleeve for receiving an elongated weight, and wherein the closure flap is movable between an open position and a closed position wherein in the open position the closure flap extends outwardly from the sleeve opposite the thumb opening and in a closed position the closure flap is extended back over the sleeve and over the inlet opening of the sleeve so as to effectively close the sleeve and secure the weight within the sleeve.

10. The glove of claim 9 wherein the weights contained within the respective sleeves on the back side of the glove are generally curved shape.

11. The glove of claim 8 wherein the weight sleeve formed on the palm side of the glove includes an elastic sleeve having opposed openings that enable an elongated weight to be inserted therein.

* * * * *